US005650794A

United States Patent [19]

Walsh

[11] Patent Number: 5,650,794

[45] Date of Patent: Jul. 22, 1997

[54] REPEAT ELECTRONIC DISPLAY DEVICE

[76] Inventor: William F. Walsh, 3129 Valley Rd., Basking Ridge, N.J. 07920

[21] Appl. No.: 377,037

[22] Filed: May 19, 1995

[51] Int. Cl.[6] ..... G09G 3/00

[52] U.S. Cl. ..... 345/56; 352/100

[58] Field of Search ..... 352/100; 345/56, 345/31

[56] References Cited

U.S. PATENT DOCUMENTS 5,108,171 4/1992 Spaulding ..... 352/100

*Primary Examiner*—Jeffery Brier

*Attorney, Agent, or Firm*—William T. Hough, Esq.

[57] ABSTRACT

A visually displayed message is repeated by reinitiation of an electronically progressively displayed message prior to the completion of the initial message while the initial message continues to move along the traveling path of observing persons moving in a common direction. The reinitiation of the message allows following observing persons moving in the common direction to see the beginning and remainder of the visually displayed message even though they could not see the message when forwardly located observing persons saw the message. The reinitiation of the visually displayed message occurs after a predetermined amount of time occurs from the initiation of the visually displayed message but before completion of the visually displayed message.

29 Claims, 3 Drawing Sheets

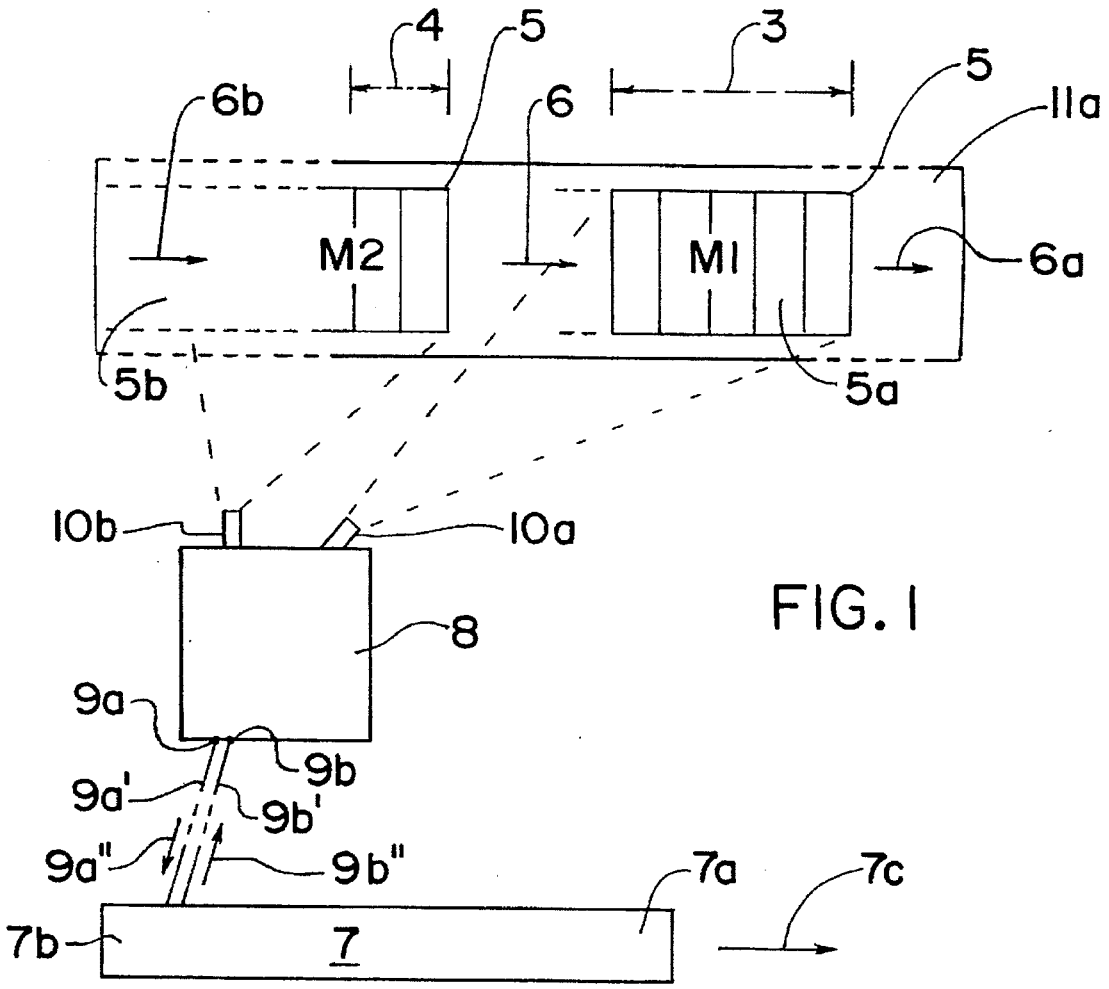
FIG. 1
FIG. 2
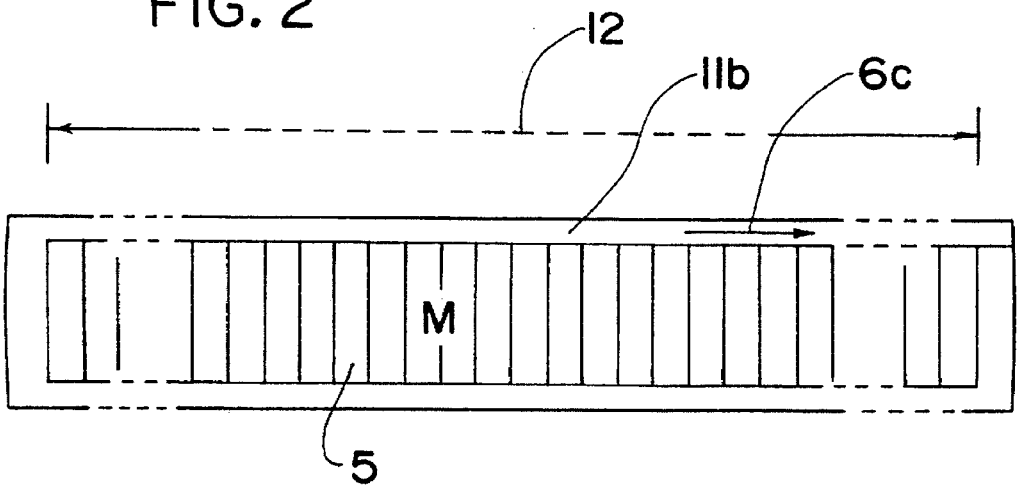

REPEAT ELECTRONIC DISPLAY DEVICE

This invention is directed to a typically light-portrayed repeatable message display as viewable by serially consecutive observer moving past the cite of the message display.

PRIOR ART

A prior art search having been conducted in which no anticipating nor teaching prior art was located, patents of interest include Bracket et al. U.S. Pat. No. 4,383,742 granted May 17, 1983, and Sollogoub U.S. Pat. No. 3,704,064 granted Nov. 28, 1972, and Minear U.S. Pat. No. 3,389,389 issued Jan. 11, 1985, and Koenig U.S. Pat. No. 3,694,062 issued Sep. 26, 1972 and Bracket et al. U.S. Pat. No. 4,179,198 issued Dec. 18, 1979, which disclose as follow:

1) Bracket et al . . . 742 patent discloses serially aligned illuminateable images which in the direction of travel of a train or subway train, become serially activated one at a time dependent upon the time of travel of the train, each subsequent activation being gauged by and a function of the speed of the train in movement a predetermined distance from one to the next illuminable image.
2) Sollogoub patent for a series of consecutive images mounted on a subway tunnel wall has for each separate image an electronic flash tube and photoelectric cell to become once activated by a passing object and/or observer, noting that a activation occurs solely after the activating object has fully passed prior to detecting a different new object.
3) Minear patent is directed to a lamp bank for progressively displaying the initial part followed by remaining parts of a light-message display, remaining parts of the message being progressively illuminated by activation of the immediately preceding activated portion of the message.
4) Kroltor patent progressively activates (illuminates) remaining portions of a message or series thereof, the rate of progressively illumination serially one at a time being dependent upon and related to the speed of the moving object and/or observes passing by the first portion of the message.
5) Bracket et al . . . 198 patent, for a serial series of equally spaced-apart displays, is gauged to the distance between a constant distance between the equally spaced-apart displays.

BACKGROUND

Prior to the present invention, for the progressively initiated light displays in tunnels, elevators and the like to catch the eye and advertise to observers of the public who is/are being transported on a train, subway, elevator or the like, each message has been gauged to become initially activated upon detection of the moving object carrying the observer, with subsequent deletion of earlier portion(s) while concurrently progressively printing out the remainder of the concurrently progressively printing-out the remainder of the continuing remainder of the entire message. As a result thereof, many or most transported observers never get to see progressively-deleted earlier portion(s) of the same earlier-begun total message, and/or if the direction of computer-movement of the message is in a direction opposite to direction of movement of the train, bus, etc.

OBJECTS OF THE INVENTION

A primary object of the present invention is to make an improvement in prior serial display illumination devices of the types generally represented by the aforestated prior art.

Another object is to make possible each and every observer walking or transported past a series of coordinated illuminating devices directed to conveying a combined message inclusive of both the aforestated early-displayed message-portion and the remainder message-portion, to easily and efficiently be exposed to the entire message(s).

Other objects become apparent from the preceding and following disclosure.

BROAD DESCRIPTION OF THE INVENTION

In its broadest aspect, the invention is directed to each of a device and a method of reactivating the beginning of a message for replay, prior to completion of the previously initiated same message, by separation of the reinitiation by a discernible but minor gap in time and space as to enable a closely following walking or otherwise transported person to have the opportunity to initially view both the beginning and remaining full message, as opposed to having already missed the beginning now extinguished message.

More particularly, the broad invention is directed to an electronic display device of the prior art (typically such as aforestated Bracket et al. patent and/or Krolton patent) substantially simultaneously detectable of: (a) the presence of a first moving object or person thereof in movement in a predetermined direction toward the display device(s), and (b) rate of speed of that movement. As with the conventional prior art, the series of display device(s) mechanism(s) is/are separately displayable of a multisymbol intelligible message inclusive of both the aforestated early-displayed message-portion and the aforenoted remainder message-portion) to a the person, utilizing a series of separate sequentially spaced-apart intermittent visual image-producing units that include at-least a sequentially positioned first one and a next-occuring second one of the series intermittently sequentially first-activatable of the aforestated first one of the series. Thereafter sequentially occuring (encountered) by the continuing prior art, there is/are provision(s) for a second-activateable of the second one of the series in the predetermined direction. Thereby the prior art jointly provides for the message to become visible to an ascertained first person that will pass in both space and time and thereafter deactivatable to thereby then turn-off the first one and to substantially concurrently to turn-on a next-occuring another one of the separate sequentially spaced-apart intermittent visual image-producing units of the series, time to match the passing the first person moving substantially past a prior last previously activated one of the separate sequentially spaced-apart intermittent visual image producing units, at a first predetermined rate of movement of sequentially second moving object or person thereof. As stated-above for the "prior art" devices, the first activated series of sequentially displayed (or printed-out) images earlier displayed sequentially over a period of time, are cancelled (deleted)—i.e. cancelled and not repeated, and thus never viewed by next-occuring viewers on a moving train or the like, for consecutively occuring ones of persons seated on a moving vehicle who are sequentially detected as in prior art.

The broad improvement invention improving the prior art is as follows. The improvement includes detecting structure(s) (and mechanisms(s) thereof):

a) for detecting the presence of the first object or person thereof in continuing sequence with at-least one other sequentially following object or person; and
b) for determining the rate of speed of the first object or person; and
c) for activating (display of) the first one of the aforestated series followed by at-least partial deactivation (deletion) of the first series; and d) for activation (display) of the aforestated second one of the aforestated series substantially concurrently with the at-least partial deactivation (deletion) of the first series, to provide available viewing by sequentially occuring sequential ones of seated persons on a moving vehicle.

As a result thereof, a time lapse occurs subsequent to activation of the second one and prior to reactivation of the first one, whereby repetition of a multisymbol intelligible message is initiateable to begin repeating prior to completion of a the same prior message. Closely spaced sequentially occuring persons are each separately thereby enabled be exposed to the entire message for the reading thereof.

In a first preferred embodiment on the aforestated broad improvement invention, at-least one of the separate sequentially spaced-apart intermittent visual image-producing unit (s) when in an activated state, include(s) at-least one number indicia.

In a second preferred embodiment on the aforestated broad improvement invention, the separate sequentially spaced-apart intermittent visual image-producing unit(s) when in an activated state, include(s) at-least one geometric symbol.

In a third preferred embodiment on the aforestated broad improvement invention, the separate sequentially spaced-apart intermittent visual image-producing unit(s) when in an activated state, include(s) at-least one picture.

In a fourth preferred embodiment on the aforestated broad improvement invention, the separate sequentially spaced-apart intermittent visual image-producing unit(s) when in an activated state, include(s) at-least one caricature In a fifth preferred embodiment on the aforestated broad improvement invention, the separate sequentially spaced-apart intermittent visual image-producing unit(s) when in an activated state, include at-least one alphabetic letter.

In a sixth preferred embodiment on the aforestated broad improvement invention, the separate sequentially spaced-apart intermittent visual image-producing units when in an activated state, include at-least one meaningful word.

In a seventh preferred embodiment on the aforestated broad improvement invention, at-least one of the units when in an activated state, include(s) at-least two meaningful words.

In a eighth preferred embodiment on the aforestated broad improvement invention, the separate sequentially spaced-apart intermittent visual image-producing units when in an activated state, include(s) at-least one configuration inclusive of at-least one animal.

In a ninth preferred embodiment on the aforestated broad improvement invention, the series when in an activated state, include(s) at-least one configuration inclusive of at-least one person.

In a tenth preferred embodiment on the aforestated broad improvement invention, the series when in an activated state, include(s) at-least one configuration inclusive of at-least one fish.

In a eleventh preferred embodiment on the aforestated broad improvement invention, the series when in an activated state, include(s) at-least one configuration inclusive of at-least one bird.

In a twelfth preferred embodiment on the aforestated broad improvement invention, the series when in an activated state, include(s) at-least one configuration inclusive of at-least one insect.

In a thirteenth preferred embodiment on the aforestated broad improvement invention, there is included wall mounting structure(s) (and mechanism(s) thereof) for substantially horizontally mounting of the series along a support wall along in juxtaposition to a path of travel of the object or person thereof.

In a fourteenth preferred embodiment on the aforestated broad improvement invention, there is included wall mounting structure(s) (and mechanism(s) thereof) for substantially vertical mounting of the series along a support wall along in juxtaposition to a path of travel of the object or person thereof.

In a fifteenth preferred embodiment on the aforestated broad improvement invention, there is(are) included wall mounting structure(s) (and mechanism(s) thereof) for substantially diagonal mounting of the series along a support wall along and in juxtaposition to a path of travel of the object or person thereof.

A second and alternate embodiment of the broad invention is directed to an improvement on prior art method(s) embodied in the aforestated prior art that includes prior art steps of detecting an oncoming object (such as a conventional train or subway train or tunnel-traveling bus or automobile) and/or observer-person(s) and within a predetermined time allowing the detected object and/or person(s) to arrive aha viewing position or location, thereafter upon arrival of the object and/or person, initiating a lighted message of a plurality of composite units jointly conveying a recognizable meaning. This method improvement broadly comprises the additional step of reinitiation of the original initiation of the lighted message after a predetermined pause sufficient to prevent confusion with the initial message's beginning but before completion of the initial message.

In a sixteenth through twenty-seven preferred embodiments, there is the additional improvement step in conjunction with each of the steps of initiation and/or reinitiation, the additional step of exhibiting the lighted visual message a lighted image(s) of one or more of the aforestated units of the message in the recognizable form of an alphabetic letter, one meaningful word, two meaningful words as a composite, an animal, a person-image, a fish, a bird, and/or an insect.

In a twenty-eighth through thirty preferred embodiments, there is the additional improvement step of exhibiting the units in a serial sequence extending one or more of substantially horizontally, and/or substantially vertically, and/or substantially diagonally.

The invention may be better understood by making reference to the drawings of the following following figures.

THE FIGURES

FIG. 1 diagrammatically and symbolically illustrates in a block and diagrammatic arrangement, a device for detecting movement of an object or person, and for thereupon activating the portrayal of a progressively advancing message of one or mere components, and of thereafter, prior to completion of the first message, beginning a repeat of the first message, relative to a detected moving object that has continued to move in the same direction, shown in elevation plan view.

FIG. 2 diagrammatically and symbolically illustrates the eventual length of the first-initiated message that would continue to its ultimate full completion, as well as likewise the FIG. 2 illustrated message have the same identity and same length in and during the reactivation that resulted in the same message at second occurrence, i.e. beginning at the time of reactivation and continuing to full completion also of the repeat message, shown in elevation plan view.

FIG. 3 diagrammatically and symbolically illustrates a computer screen illustrating consecutive messages of serially consecutive alphabetic letters, in an elevation plan view, shown in elevation plan view.

FIG. 4 diagrammatically and symbolically illustrates a computer screen illustrating consecutive messages of serially consecutive numbers, shown in elevation plan view.

FIG. 5 diagrammatically and symbolically illustrates a computer screen illustrating consecutive messages of serially consecutive geometric symbols, shown in elevation plan view.

FIG. 6 diagrammatically and symbolically illustrates a computer screen illustrating consecutive messages of serially consecutive pictures, shown in elevation plan view.

FIG. 7 diagrammatically and symbolically illustrates a computer screen illustrating consecutive messages of serially consecutive caricatures, shown in elevation plan view.

FIG. 8 diagrammatically and symbolically illustrates a computer screen illustrating consecutive messages of serially consecutive groups or at-least two or more different words, shown in elevation plan view.

DETAILED DESCRIPTION

Figure 3:
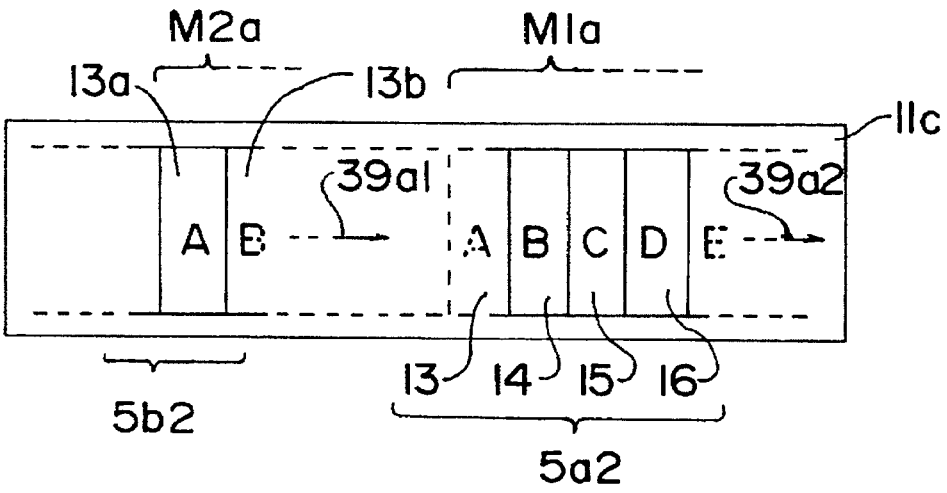

As compared to the aforestated prior art where there were fixed images on the wall of typically a subway or other tunnel for train or automobile, but not limited to such examples, where heretofore persons riding on subways, trains, buses or the like conveniently are able to view the entire message of two or mere units and/or of extended length sentences or the like, solely the first, upfront viewer has been heretofore afforded the opportunity to view the entire message, since immediately-following persons lacked physical positioning that would have permitted (enabled) them to see the early-on first parts of the message(s). Accordingly, while the first message is appropriately electronically or otherwise transmitted and controlled to move-along in the infra-red light, ultrasound (ultrasonics), ultraviolet light, and/or the like.

The preferred type of a horizontal and/or vertical or other direction of movement of the activated exhibiting windows is useful additionally, for example in a rollercoaster-type movement to produce a greater sense of reality of the desired effect(s). Obviously esculators, elevators, moving transport belts, as well as subway or train or bus tunnel-traveling vehicles afford the most obvious and practical cite for employment of the present invention.

In greater illustrative explanation generically, FIGS. 1 and 2 commulatively illustrate diagrammatically the aforestated invention, as follows.

FIG. 1 illustrates the entire combination, while FIG. 2 illustrates a symbolic entire elongated message(s) or alternatively single component message having multiple parts thereof—intending to illustrate principally a single "entire" activation or reactivation, although the entire message is not necessarily portrayed or exhibited simultaneously, but in progressive segments. At any point along the length of the FIG. 2-illustrated message, prior to completion of the entire first-activation, the second activation may begin but at a physical location physically located spaced behind and following the continuing revelation of the first-activated (first initiated) same message.

Accordingly, FIG. 1 illustrates a typical aforementioned computer screen 11*a* showing serially located from right to left, the beginning portions 5*a* (shown on the initially-activated diagram as M1) of an entire message 5, following by the reactivation second (subsequent in time and space) beginning portions 5*b* (shown on the reactivation-activated diagram as M2) of the repeated same message 5, both moving in common directions 6*a* and 6*b* cummulatively represented by direction 6 for the entire computer screen(s) (or board(s)) 11*a*. In the FIG. 1 illustration, the FIG. 5*a* beginning portions has proceeded to the extent of the larger amount or extent (degree) of time or length dimension 3 and the subsequent reinitiation (reactivation) portion 5*b* has proceeded in its activation to the thus-far smaller amount or extent of time or length dimension 4, recognizing that each of messages M1 and M2 will independently proceed to the completion of the entire message M (message 5) of FIG. 2, prior to each and both ceasing until a subsequent other future initial activation, when the next train, subway, bus, etc. comes along. The computer logic and activation mechanism and detector and responsive initial and/or subsequent second, third, etc. detection for one or more reinitiations (reactivations) is cummulatively designated computer element 8. From computer element 8, detector mechanism 9*a* sends an electronic and/or light or other signal or beam 9*a*' moves in direction 9*a*" which when intercepted by solid moving object 7 moving in direction 7*c* as to its front end 7*a* and rear end 7*b*, causes a reflection or bounced or otherwise return-signal 9*b*' moving in direction 9" to detector 9*b*. When the detector 9*b* receive the initial signal, its initiation (activation) mechanism and symbolic device of 10*a* begins to send necessary signal(s) and/or beams to the exhibiting-board of the computer screen to thereby begin the sequentially activated/portrays, (made visually discernible) message 1 or earlier components 5*a* thereof. If and when the computer element 8 electronically discerns a continuing of the "same" moving object 7 beyond a previously-set desired (set) predetermined distance-traveled and/or time-expired since the initial initiation (by way of symbolic mechanism and structure 10*a* ), reactivation automatically takes place to begin a second-showing initiation mechanism(s) 10*b* to portray (exhibit) M2 message beginning its exhibition or partial exhibition thereof—to thereafter continue to its completion, while concurrently the ever-advancing Mi also continues to its completion. Obviously also a beam does not necessarily have to be bounced-back, there being alternative technology of—for example—the moving subway vehicle, train or bus merely moving (and continuing uninterruptedly to move) between the source and the straight-line detector of the electronic beam of light. The device(s) 10*a* and 10*b* accordingly are not intended to be "literal" as though merely shining an image, but symbolically include any of a multitude of conventional wired and/or wireless circuitries by which the ongoing message M1 and later one or more of messages M2 are convey sufficiently to become visually discernible to the observing person(s).

FIG. 2, as aforestated, represents the complete message M made up of its consequential consecutively sequentially activated incomplete portions 5 thereof (of complete message M), cummulatively extending the entire message length and/or time-sequence 12, moving in direction 6*c*.

FIG. 3 diagrammatically and symbolically illustrates a computer screen 11*c* illustrating the first portion as serially consecutive message-portion as first in-part portion M1*a* of serially consecutive repeat message-portions, namely alphabetic letters 5*a*2 and 5*b*2. The first message in-part portion (A through E) identified as indicia 13 through 15 . . . —i.e. message M1*a*, is not completed—being solely typically beginning indicia 13 through only 15—at the time of the beginning portions of the repeat message's beginning letter A —identified as letter 13 (of letters A and B) identified as letters 12*a* and 12*b* . . . , i.e. message M2*a*.

Figure 4:
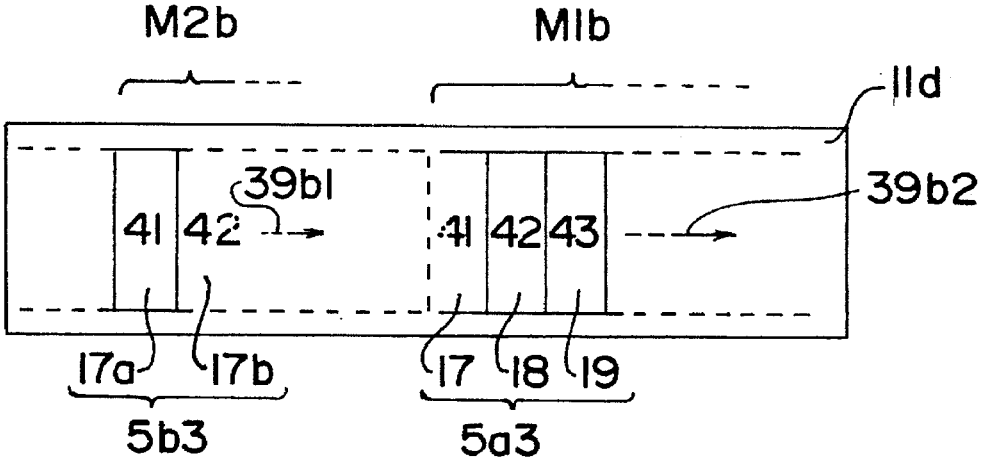

FIG. 4 diagrammatically and symbolically illustrates a computer screen lid illustrating the first portion of serially consecutive message-portions as first in-part message-portion M1*b* of serially consecutive repeat message-portions 5*a*3 and 5*b*3. The first message in-part portion (41 through 43) —i.e. i.e. e M1*b*, is not completed—being thus far solely typically beginning indicia 17 through only 19—at the time of the beginning portions of the repeat message's beginning number 41 (identified as numeral 17*a*) to be continued as numbers 33 or more—as repeat-message M2*b* (of numerals 17, 18, 19 . . . ) identified as numerals 17*a* and 17*b* . . . Each of messages 39*b*1 and 39*b*2 are moving in the same directions as the train, bus, etc.

Figure 5:
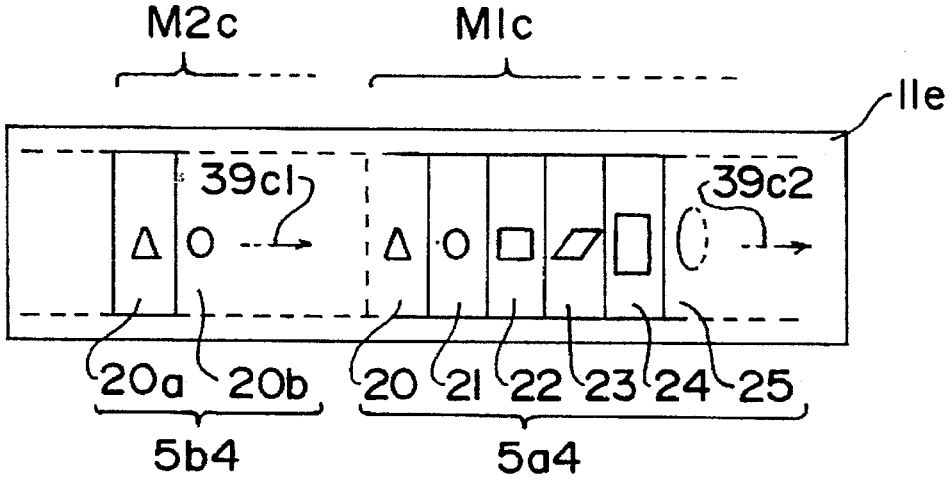

FIG. 5 diagrammatically and symbolically illustrates a computer screen 11*e* illustrating consecutive message-portions of serially consecutive message-portions, namely geometric symbols triangle ranging through rectangle as shown as repeat messages, shown as repeate message-portions 5*a*4 and 5*b*4. The first message in-part portion (triangle through the rectangle, serially arranged as shown) —i.e. M1*c*, is not completed—being thus far solely typically beginning geometric symbols or configurations of indicia 20 through 25, at the time of the beginning portions of the repeat message's beginning geometric symbol-triangle identified by indicia 20*a* (of geometric configurations triangle 20*a* and circle 21), i.e. message. M2*c*. The entire in-part portion 5*a*4 includes serially the triangle as indicia 20, next the circle as indicia 21, next the square as indicia 22, next the parallelogram as indicia 23, next the rectangle as indicia 24, followed next by a hexagon (shown in-part) as indicia 25.

Figure 6:
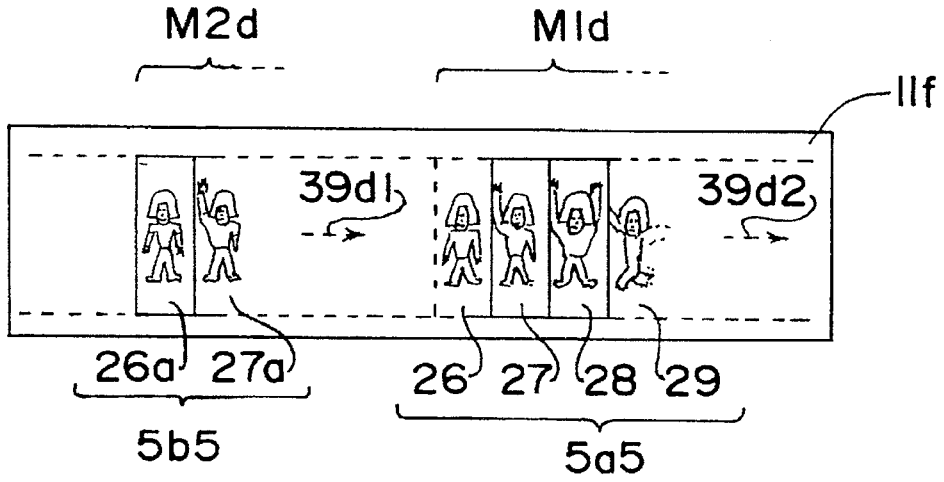

FIG. 6 diagrammatically and symbolically illustrates a computer screen 11*f* illustrating consecutive message-portions of serially consecutive pictures of a single first message M1*d* that has progressed to display solely an in-part message portion 5*a*5 of the entire message M1*f* of serially consecutive pictures. The first in-part portion identified as message M1*d* showing thus-far the series of pictures ranging from picture of indicia 26 through picture (in-part) of indicia 29 represents the entire thus-far in-part portion 5*a*5 and includes serially consecutive pictures of a first frame indicia 26 revealing a standing-girl face onward with hanging arms, followed by a next sequentially consecutive picture of indicia 27 of the same girl shown waving her right hand and arm in raised position, followed by a third frame or picture of indicia 28 with the same girl waving both arms and kicking-up her left leg, followed by a fourth frame shown in-part of the same girl in a different position, identified by indicia 29. Thus, the first message portion of pictures indicia 26 through 29 (shown in-part)—i.e. message-portion M1*d* of which pictures of indicia in-part message 5*a*5, is not a completed message—being indicia 13 through 15 —at the time of the beginning portions of the repeat in-part message M2*d* that include thus-far solely pictures 26*a* and 27*a* as a beginning beginning repeat message (replay)—identified as repeat message 5*b*5, i.e. message M2*d*.

Figure 7:
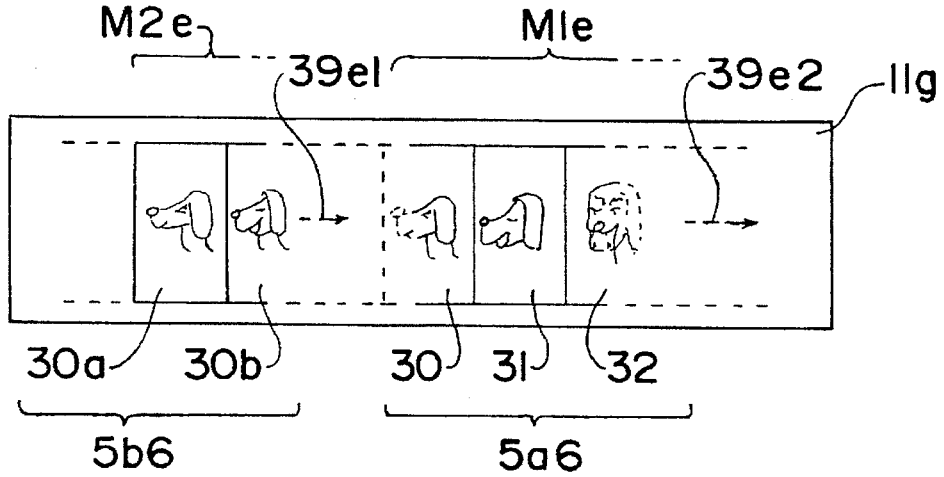

FIG. 7 diagrammatically and symbolically illustrates a computer screen 11*g* illustrating consecutive in-part message embodied within a one or more series serially consecutive caricatures of initial message M1*e* and its repeat message M2*e*, again noting that the first in-part message portion of side-face dog caricature 30 through forward (on-face/frontal) face dog caricature 32 (for example), is not a totally-completed message at the time of the beginning portion of the repeat message-port's M2*e* beginning repeat characture 30*a* (a repeat of the former frame/caricature of indicia 30) and partial repeat frame 30*b* repeating frame 31. The initial message M1*e* includes at-least more frames than the first two caricature frame of indicia 30 and 31 at the time that the repeat begins by caricature of indicia 30*a* of caricatures indicia 5*b*6 of complete repeated frame 30*a* versus carictures of indicia 5*a*6. Caricatures of indicia 5*a*6 disclose a dog-head caricature in side view at indicia 30, followed by indicia 31 partial oblique dog-head view of the same caricature with a partially opened mouth with exposed teeth, followed by indicia 32 of a forward view of caricature of indicia 32 with a snarling teeth-exposed view, as three of a potenially longer series of frames or the like. Reinitiated message portion exhibits frame 30*a* and partial frame 30*b* of repeat message M2*e*.

Figure 8:
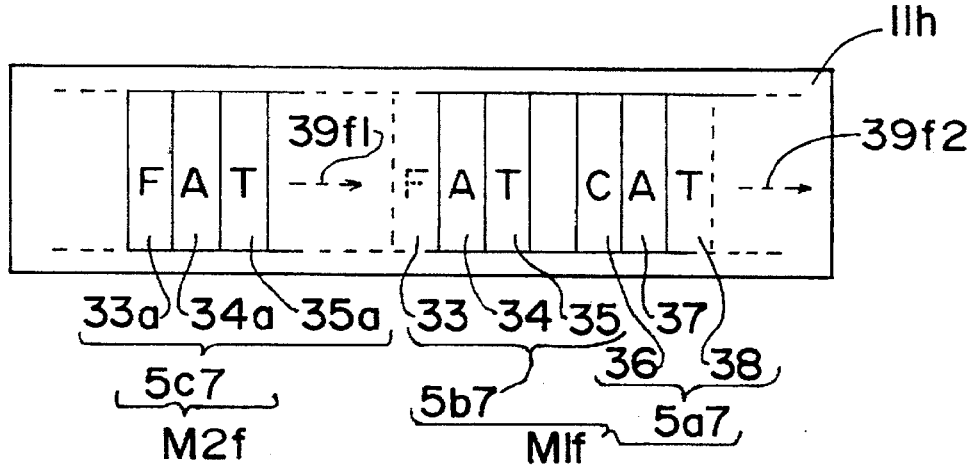

FIG. 8 diagrammatically and symbolically illustrates a computer screen 11*h* illustrating consecutive in-part message-portions advancing in direction 39*f*2 and 39*f*1 respective, of serially consecutive groups of at-least two or more different words having or building a recognizable or cognizable meaning or thought. As shown here, "FAT CAT" of message M1*f* may be the complete phrase, or merely a part thereof, noting that the in-part message "FAT" 5*b*7 would have begun at-least prior to the completion of the showing of the full (total) message 5*a*7 of initial message M1*f* letters of the word "CAT", i.e. the repeat message M2*f* would begin prior to completion of the message M1*f*. The message M1*f* includes message portion 5*b*7—the first word of letters F of indicia 33 and A of indicia 34 and T of indicia 35—as a single word (or part thereof) "prior to" the beginning of the showing/lighting or otherwise revealing of the letter "C" of indicia 36 of message portion 5*a*—the word "CAT" of indicia 5*a* of the message M1*f*. In the present illustration, since the (for example) lighting of the word "FAT" of first word 5*b*7, the word "CAT" of the second word 5*a*7 and the word "FAT" of the repeat word 5*c*7 of indicia letters 36, 37 and 38 will have additionally become lighted substantially concurrently, as each of the messages M1*f* and M2*f* each run to their complete phrase (or words) series as preprogrammed in the computer (or other mechanism).

As illustrated in each of the illustrations of FIGS. 3 through 8, if the train, subway or bus or the like, is moving in direction 39*a*1, 39*a*2, 39*b*1, 39*b*2, 39*c*1, 39*c*2, 39*d*1, 39*d*2, 39*e*1, 39*e*2, 39*f*1 and 39*f*2, the computer preferably is programmed such that each and both of the in-part (and eventually entire) messages thereof move in that same direction along the computerized screen(s) 11*c* through 11*h*. The movement at a rate consistent with or approximating the speed of movement of the train, subway, bus or the like, results in the in-part and eventually complete message being revealed to the same one or more persons substantially in front the progressively revealed entire message portions. The person(s) riding further-back in the train and/or bus, etc., are thus too far rearwardly to see the first message, but have the benefit of viewing the entire second message as it begins and continues lighting-up gradually to its complete message.

It should be noted that while it is possible for the computer screen (board) to be sufficiently long to concurrently exhibit an entire first message concurrently with an entire following second entire repeat message, more often and preferably the screen may be and is not required to be of such extended length, the previously-read earlier portions of a message being thereafter obviated, as either and/or each of the remaining portion(s) of the initial and repeat messages continue to be spelled-out. It is possible that the rate of spelling-out the remainder of the message (and/or the repeat message) moves in the same direction of travel of the train or bus at a rate such that the entire "presently-showing" (at any particular point in time) message (or repeat message) may "not" have to be moved (as an entire exhibit in-part or whole portion thereof) at-all in the direction of movement of the train, bus or the like. However, if the viewing passenger (of the bus, train, etc.) is moving in a direction opposite to the elongation of the message(s), then it becomes more desireable to move the entire shown-message (at any point in time) in the direction of the train, while concurrently repeating the inventive programmed repeat of the message by message M2 beginning before completion of message M1, to thus avoid the possibility of the messages moving out of viewing range of the viewing person(s).

It is within the scope and contemplation of the preceeding invention to include modification(s), variation(s) and/or substitution of equivalent(s) within the skill of an ordinary artisan.

I claim:

1. In an electronic display device substantially simultaneously detectable of the presence of a first moving object or person thereof moving in a predetermined direction toward the device and separately displayable of a multisymbol intelligible message to a said person, utilizing a series of separate sequentially spaced-apart intermittent visual image-producing units that include at-least a sequentially positioned first one and a next-occuring second one of said series intermittently:

a) sequentially first-activateable of said first one and thereafter b) second-activateable of said second one in said predetermined direction, so as to become visible to said first person passing in both space and time and thereafter deactivateable to thereby:

c) turn-off the first one and d) substantially concurrently turn-on a next-occuring another one of the separate sequentially spaced-apart intermittent visual image-producing units of the series, as the passing said first person moves substantially past a prior last previously activated one of the separate sequentially spaced-apart intermittent visual image producing units, at a first predetermined rate of movement of sequentially second moving object or person thereof, the improvement comprising i) for detecting the presence of the first object or person thereof in continuing sequence with at-least one other sequentially following object or person; and ii) for determining the rate of speed of the first object or person; and iii) for display of the first one of the series followed by at-least partial deletion of the first series; and iv) for display of the second one of the series substantially concurrently with the at-least partial deletion of the first series, to provide available viewing by sequentially occuring ones of seated persons on a moving vehicle, whereby repetition of a multisymbol intelligible message is reinitiateable at substantially concurrent deletion of a first-occuring portion of and prior to completion of the first series such that closely spaced sequentially occuring persons are each separately enabled to be exposed to an entire message for the reading thereof.

2. The improvement of claim 1, in which at-least one of said separate sequentially spaced-apart intermittent visual image-producing units when in an activated state includes at-least one number indicia.

3. The improvement of claim 1, in which said separate sequentially spaced-apart intermittent visual image-producing units when in an activated state include at-least one geometric symbol.

4. The improvement of claim 1, in which said separate sequentially spaced-apart intermittent visual image-producing unit when in an activated state include at-least one picture.

5. The improvement of claim 1, in which said separate sequentially spaced-apart intermittent visual image-producing units when in an activated state include at-least one caricature.

6. The improvement of claim 1, in which said separate sequentially spaced-apart intermittent visual image-producing units include at-least one alphabetic letter.

7. The improvement of claim 1, in which said separate sequentially spaced-apart intermittent visual image-producing units include at-least one meaningful word.

8. The improvement of claim 1, including substantially subsequent to at-least one of said initiation and said reinitiation, causing at least a portion of said lighted message to move in a common direction of movement of a detected oncoming object or observer-person at a substantially contain rate of speed, while concurrently continuing at least a portion of at least one of initiated or reinitiate said lighted message.

9. The improvement of claim 1, in which at-least one of said units includes at-least two meaningful words.

10. The improvement of claim 1, in which said separate sequentially spaced-apart intermittent visual image-producing units include at-least one configuration inclusive of at-least one animal.

11. The improvement of claim 1, in which said series includes at-least one configuration inclusive of at-least one animal.

12. The improvement of claim 1, in which said separate sequentially spaced-apart intermittent visual image-producing units include at-least one animal.

13. The improvement of claim 1, including wall mounting means for substantially horizontally mounting of said series along a support wall along in juxtaposition to a path of travel of said object or person thereof.

14. The improvement of claim 1, including wall mounting means for substantially vertical mounting of said series along a support wall along in juxtaposition to a path of travel of said object or person thereof.

15. The improvement of claim 1, including wall mounting means for substantially diagonal mounting of said series along a support wall along in juxtaposition to a path of travel of said object or person thereof.

16. In a prior art method of detecting sequentially oncoming objects or persons, within a predetermined time sufficient to allow the object or observing person to arrive at a viewing position or location, thereafter initially initiating a lighted message of a plurality of sequential composite units jointly conveying a recognizable meaning, the method improvement broadly comprising the additional step of reinitiation of the original initiation of the lighted message after a predetermined pause sufficient to avoid confusion of next sequentially-occuring said oncoming person by said initially reinitiating by the initial message's beginning, the step of reinitiation being at a point in time occuring before completion of said plurality of composite units of the initial message.

17. In the improvement of claim 16, exhibiting the lighted visual message a lighted image of one or more of the units of the message in the recognizable form of at least one alphabetic letter.

18. In the improvement of claim 16, exhibiting the lighted visual message as a lighted image of one or more of the units of the message in the recognizable form of at least one meaningful word.

19. In the improvement of claim 16, exhibiting the lighted visual message as a lighted image of one or more of the units of the message in the recognizable form of at least one alphabetic letter.

20. In the improvement of claim 16, exhibiting the lighted visual message a lighted image of one or more of the units of the message in the recognizable form of at least two meaningful words as a composite.

21. In the improvement of claim 16, exhibiting the lighted visual message a lighted image of one or more of the units of the message in the recognizable form of at least an animal.

22. In the improvement of claim 16, exhibiting the lighted visual message a lighted image of one or more of the units of the message in the recognizable form of at least a person-image.

23. In the improvement of claim 16, exhibiting the lighted visual message a lighted image of one or more of the units of the message in the recognizable form of at least a fish.

24. In the improvement of claim 16, exhibiting the lighted visual message a lighted image of one or more of the units of the message in the recognizable form of at least a bird.

25. In the improvement of claim 16, exhibiting the lighted visual message as a lighted image of one or more of the units of the message in the recognizable form of at least an insect.

26. In the improvement of claim 16, including wall mounting structure and mechanism thereof sufficient that said series is substantially diagonally mounted along a support wall extending along and in juxtaposition to as a path of travel of the object or person thereof.

27. In the improvement of claim 16, including providing and erecting wall mounting structure and mechanism thereof sufficient that said series is substantially horizontally mounted along a support wall extending along and in juxtaposition to as a path of travel of the object or person thereof.

28. In the improvement of claim 16, including providing and erecting wall mounting structure and mechanism thereof sufficient that said series is substantially vertically mounted along a support wall extending along and in juxtaposition to as a path of travel of the object or person thereof.

29. In the improvement of claim 16, during at-least a portion of at least one of said initiating and said reinitiation, causing at least one of a resulting initiated message and of a reinitiated message message to in a common direction of movement at least one of the object and the observing person at a substantially common rate of speed.

* * * * *